US008540484B2

(12) United States Patent
Hollman et al.

(10) Patent No.: US 8,540,484 B2
(45) Date of Patent: Sep. 24, 2013

(54) LOW MASS DIFFUSER VANE

(75) Inventors: Timothy M. Hollman, San Diego, CA (US); Kevin K. Taft, La Mesa, CA (US); Gordon F. Jewess, San Diego, CA (US)

(73) Assignee: United Technologies Corporation, Hartford, CT (US)

( * ) Notice: Subject to any disclaimer, the term of this patent is extended or adjusted under 35 U.S.C. 154(b) by 586 days.

(21) Appl. No.: 12/842,167

(22) Filed: Jul. 23, 2010

(65) Prior Publication Data

US 2012/0020779 A1 Jan. 26, 2012

(51) Int. Cl.
*F01D 9/04* (2006.01)

(52) U.S. Cl.
USPC ..... 415/208.4; 415/208.3

(58) Field of Classification Search
USPC ..... 415/208.2, 208.3, 208.4, 211.1, 211.2, 415/164, 166
See application file for complete search history.

(56) References Cited

U.S. PATENT DOCUMENTS

| | | | | |
|---|---|---|---|---|
| 2,701,682 | A | 6/1953 | Dallenback et al. | |
| 3,264,822 | A | 8/1966 | Lane et al. | |
| 3,799,694 | A | 3/1974 | Duzan | |
| 3,904,312 | A * | 9/1975 | Exley | 415/208.3 |
| 3,930,746 | A * | 1/1976 | Kronogard | 415/208.3 |
| 4,027,997 | A * | 6/1977 | Bryans | 415/208.3 |
| 4,182,117 | A * | 1/1980 | Exley et al. | 415/208.3 |
| 4,228,753 | A | 10/1980 | Davis et al. | |
| 4,431,374 | A | 2/1984 | Benstein et al. | |
| 4,815,935 | A * | 3/1989 | Gottemoller | 415/211.1 |
| 4,854,126 | A * | 8/1989 | Chevis et al. | 415/208.3 |
| 4,981,018 | A * | 1/1991 | Jones et al. | 415/143 |
| 5,088,890 | A * | 2/1992 | Jewess | 415/112 |
| 5,520,507 | A * | 5/1996 | Haugen | 415/208.3 |
| 5,664,413 | A * | 9/1997 | Kington et al. | 415/174.5 |
| 6,814,540 | B2 | 11/2004 | Sishtla et al. | |
| 7,101,151 | B2 | 9/2006 | Loringer et al. | |
| 7,186,077 | B2 * | 3/2007 | Daudel et al. | 415/164 |
| 7,442,006 | B2 * | 10/2008 | Nguyen et al. | 415/208.4 |
| 7,625,181 | B2 * | 12/2009 | Matsuda et al. | 415/208.2 |

* cited by examiner

*Primary Examiner* — Christopher Verdier
(74) *Attorney, Agent, or Firm* — Kinney & Lange, P.A.

(57) ABSTRACT

A wedge-type diffuser includes a diffuser floor and a plurality of wedge-shaped vanes. The wedge-shaped vanes extend from the diffuser floor and have a top surface, a leading edge and a trailing edge. Each of the wedge-shaped vanes has a slot extending from the trailing edge toward the leading edge.

17 Claims, 7 Drawing Sheets

LOW MASS DIFFUSER VANE

STATEMENT OF GOVERNMENT INTEREST

The U.S. Government has a paid-up license in this invention and the right in limited circumstances to require the patent owner to license others on reasonable terms as provided for by the terms of Contract No. N0019-06-C-0081 awarded by NAVAIR.

BACKGROUND

The present invention relates to diffusers, and in particular, to a wedge-type diffuser for use in gas turbine engines. In some gas turbine engines a diffuser is positioned downstream of a compressor impeller to receive compressed gas and reduce the flow velocity, thus converting kinetic energy of the compressed gas into static pressure. Such diffusers often have vanes for improving efficiency and reducing vortices. Using a vaned diffuser adds undesirable mass, and consequently weight, to the gas turbine engine. In applications where it is especially important to reduce weight, such as gas turbine engines used on aircraft, the additional mass of a vaned diffuser is especially undesirable.

SUMMARY

According to the present invention, a wedge-type diffuser includes a diffuser floor and a plurality of wedge-shaped vanes. The wedge-shaped vanes extend from the diffuser floor and have a top surface, a leading edge, and a trailing edge. Each of the wedge-shaped vanes has a slot extending from the trailing edge toward the leading edge.

DETAILED DESCRIPTION

Figure 1:
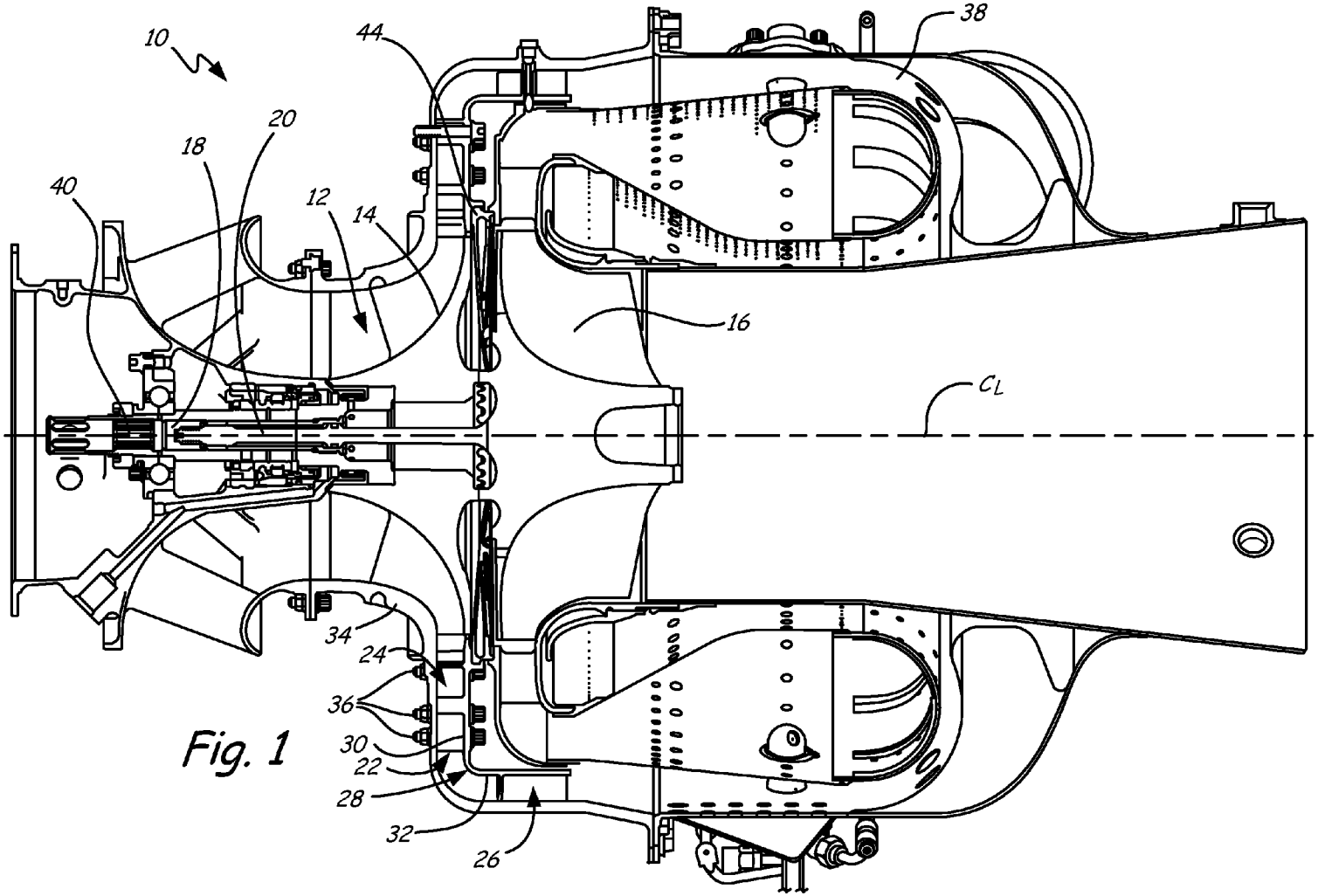
FIG. 1 is a side view of a gas turbine engine.

FIG. 1 is a side view of gas turbine engine 10 having rotor assembly 12 which includes compressor impeller 14 connected to turbine 16 by impeller shaft 18 being threadedly engaged with tie bolt 20. This allows for compressor impeller 14 to be driven by turbine 16 rotatably about centerline axis $C_L$. Diffuser 22 is a wedge-type diffuser with wedge-shaped vanes 24 and straightener vanes 26 extending from diffuser floor 28. Wedge-shaped vanes 24 extend from radially-extending inner platform 30 of diffuser floor 28. Straightener vanes 26 extend from outer platform 32 of diffuser floor 28, which extends longitudinally, substantially parallel to centerline axis $C_L$. Diffuser 22 is connected to shroud 34 via bolts 36 extending through both diffuser 22 and shroud 34 such that wedge-shaped vanes 24 are positioned between shroud 34 and diffuser floor 28.

Diffuser 22 is positioned along a gas flow path adjacent and downstream of compressor impeller 14 for receiving compressed gas, reducing the flow velocity of that compressed gas, and thus converting kinetic energy of the compressed gas into static pressure. Straightener vanes 26 reduce vortices that could otherwise blow out a flame in combustor 38, which is positioned along the gas flow path adjacent and downstream of diffuser 22. Turbine 16 is also positioned along the gas flow path, adjacent and downstream of combustor 38, for extracting energy from high pressure gas received from combustor 38. Turbine 16 transmits power via tie bolt 20 to impeller shaft 18, which drives not only compressor 12 but also has spline 40 for transmitting power to a gearbox (not shown) for driving various components (not shown), such as a propeller, generator, hydraulic pump, other aircraft components, or even non-aircraft components. Seal plate 44 is adjacent diffuser floor 28 and provides a seal between compressor impeller 14 and turbine 16.

Figure 2:
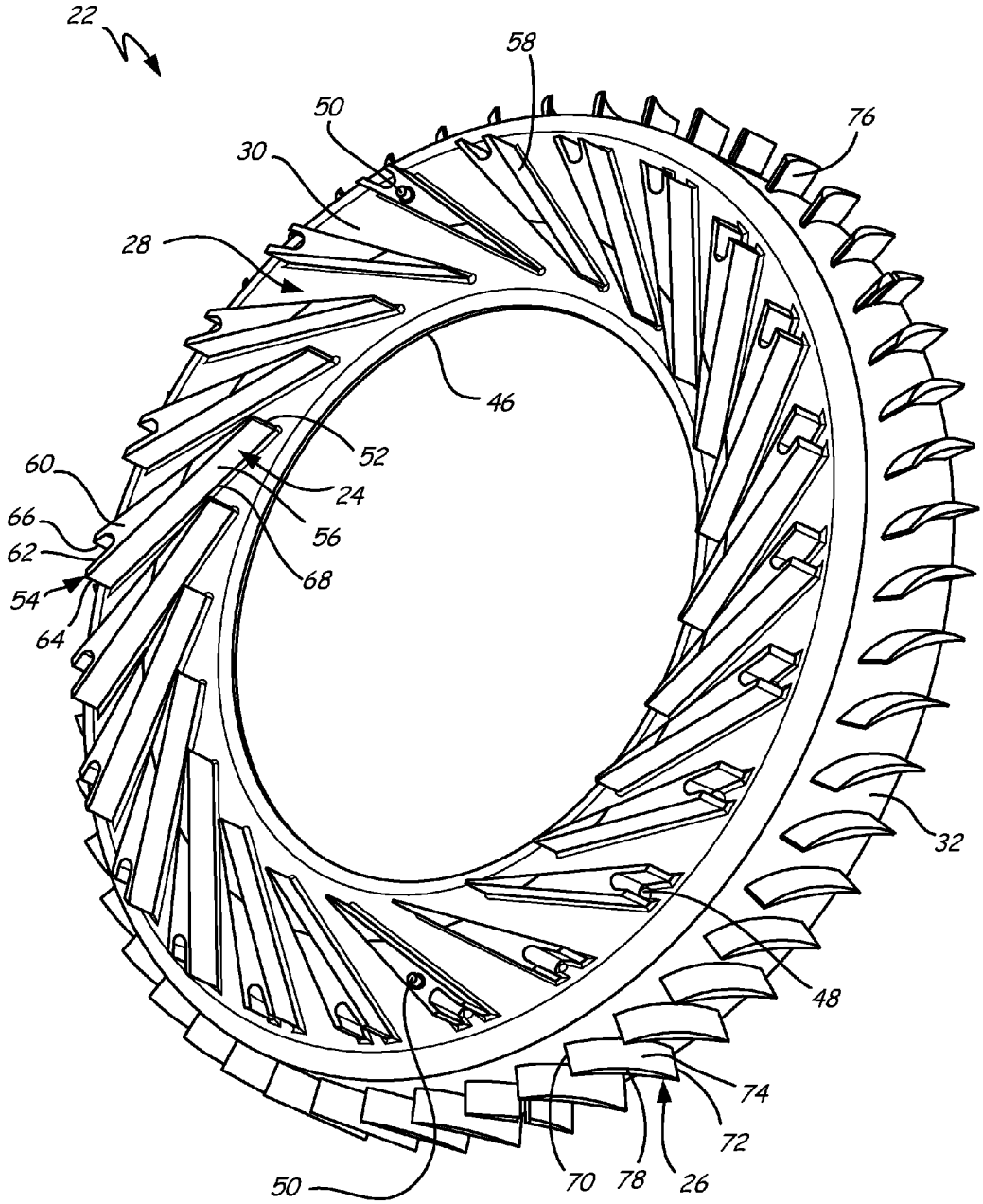
FIG. 2 is a perspective view of the diffuser used in the gas turbine engine of FIG. 1.

FIG. 2 is a perspective view of diffuser 22, showing tapered inner rim 46 of inner platform 30 which interfaces with compressor impeller 14 (shown in FIG. 1). A plurality of bolt holes 48 extend through diffuser floor 28 and each of the plurality of wedge-shaped vanes 24, for allowing bolts 36 (shown in FIG. 1) to connect diffuser 22 to shroud 34 (shown in FIG. 1). Alignment pins 50 align diffuser 22 with shroud 34 and the rest of gas turbine engine 10 (shown in FIG. 1) about centerline axis $C_L$ (shown in FIG. 1).

Each wedge-shaped vane 24 has leading edge 52, trailing edge 54, pressure side surface 56, suction side surface 58, and top surface 60. Trailing edge 54 is wider than leading edge 52, and wedge-shaped vane 24 tapers substantially continuously from trailing edge 54 to leading edge 52. Top surface 60 is defined between pressure side surface 56 and suction side surface 58. Compressed gas from compressor impeller 14 flows along and between pressure side and suction side surfaces 56, 58 of adjacent wedge-shaped vanes 24 from leading edge 52 to trailing edge 54. Flow velocity is reduced and static pressure is increased as the gas passes between each diverging pair of wedge-shaped vanes 24.

Each wedge-shaped vane 24 has a slot 62 extending from trailing edge 54 toward leading edge 52. In the illustrated embodiment, slot 62 extends along a portion of top surface 60, from trailing edge 54 to bolt hole 48, and along an entire length of trailing edge 54, from top surface 60 to diffuser floor 28. In the illustrated embodiment, slot 62 is substantially centered on trailing edge 54, effectively forming two legs 64, 66 at trailing edge 54 that define slot 62. In the illustrated embodiment, leg 64 is longer than leg 66. Each respective leg 64, 66 has a substantially constant width along a portion of its length.

Slot 62 reduces the mass of each wedge-shaped vane 24, and consequently, reduces the weight of the entire diffuser 22. Because trailing edge 54 is wider than leading edge 52, slot 62 can be added to trailing edge 54 without reducing the strength of wedge-shaped vanes 24 below a suitable threshold. Flow of gas through diffuser 22 can create an aerodynamic wake at trailing edge 54. Slots 62 can be sized so as to have a negligible effect on aerodynamic wake created at each trailing edge 54 during operation of gas turbine engine 10. The size of slots 62 can be selected by factoring requirements for strength, mass reduction, and gas flow.

Leading edge 52, trailing edge 54, pressure side surface 56, and suction side surface 58 of each wedge-shaped vane 24 are connected to inner platform 30 of diffuser floor 28 at filleted interface 68. Interface 68 is also filleted at slot 62. Filleting can help improve strength characteristics of wedge-shaped vanes 24 at these locations.

Each straightener vane 26 has leading edge 70, trailing edge 72, suction side surface 74, pressure side surface 76, and outer surface 78. Leading edge 70 of straightener vane 26 is positioned radially outward from trailing edge 54 of wedge-shaped vane 24. Compressed gas from wedge-shaped vanes 24 flows along and between suction side and pressure side surfaces 74, 76 of adjacent straightener vanes 26 from leading edge 70 to trailing edge 72. Curvature of suction side and pressure side surfaces 74, 76 straightens the gas flow to reduce vortices.

Diffuser 22 can be manufactured by first forming diffuser 22 with a plurality of wedge-shaped vanes 24 extending from diffuser floor 28 using casting, machining, or a combination of casting and machining. Diffuser 22 can be made of various materials, such as 15.5 steel, titanium, or aluminum, depending on application requirements. Next, slots 62 can be created by machining to remove material from each trailing edge 54 of each wedge-shaped vane 24. In one embodiment, the material can be removed by first drilling bolt hole 48 in one of wedge-shaped vanes 24 and then cutting back from bolt hole 48 to trailing edge 54. Cutting can be done in a single pass or can include multiple cutting passes. Alternatively, the material can be removed by cutting from trailing edge 54 in toward leading edge 52, in single or multiple cutting passes. At some point of the process, some or all of interface 68, including that at slot 62 and trailing edge 54, can be filleted for improved strength. The resulting wedge-type diffuser 22 can be relatively light weight, reliable, and easy to manufacture.

Figure 3:
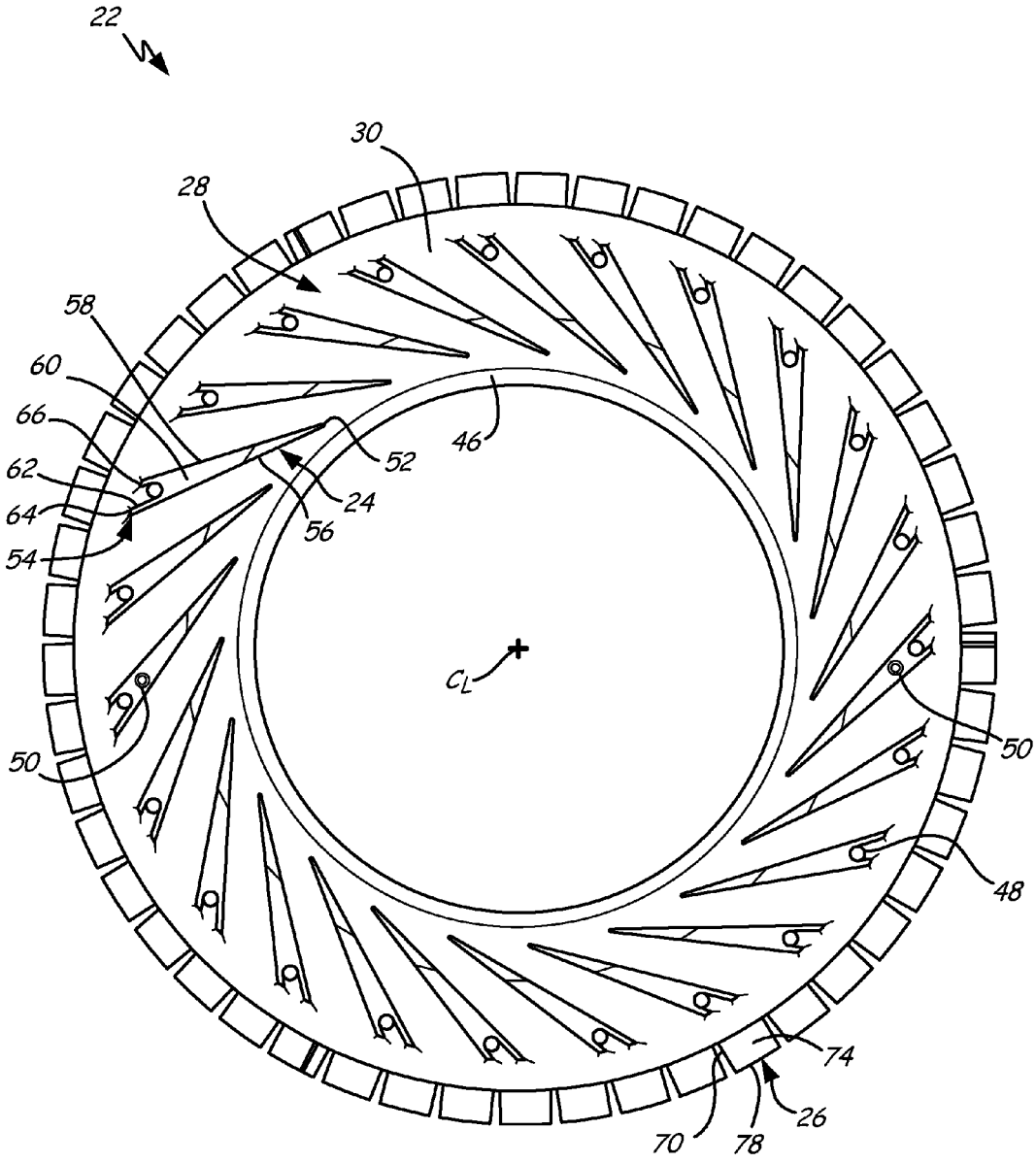
FIG. 3 is a top view of the diffuser of FIG. 2.

FIG. 3 is a top view of diffuser 22. FIG. 3 shows each wedge-shaped vane 24 being substantially identical and arranged with rotational symmetry about centerline axis $C_L$. Each wedge-shaped vane 24 is tilted with respect to centerline axis $C_L$.

Figure 4A:
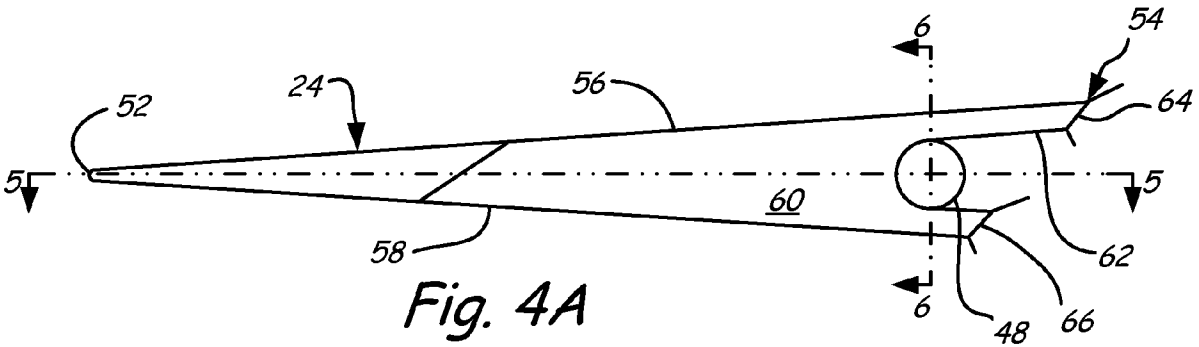
FIG. 4A is top view of a wedge-shaped vane of the diffuser shown in FIGS. 2 and 3.

FIGS. 4A, 4B, 4C, and 4D are top views of alternative embodiments, each of a single illustrative example wedge-shaped vane 24. FIG. 4A shows the embodiment of wedge-shaped vane 24 illustrated in FIGS. 2 and 3. Slot 62 extends from trailing edge 54 to bolt hole 48. At bolt hole 48, slot 62 has a width substantially equal to a diameter of bolt hole 48 and then gradually widens toward trailing edge 54.

Figure 4B:
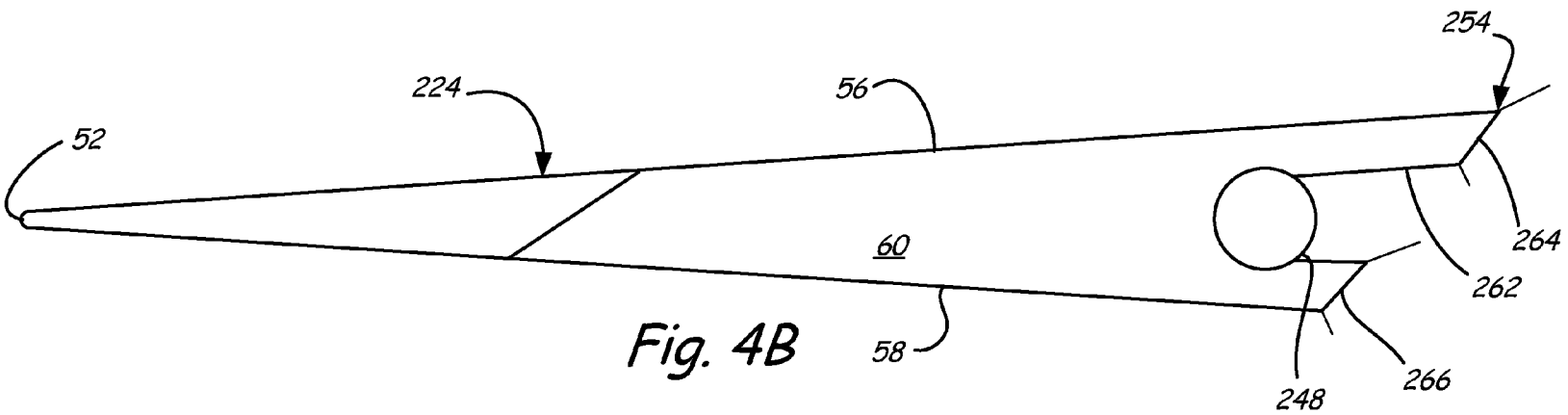
FIG. 4B is a top view of a second embodiment of the wedge-shaped vane of the diffuser shown in FIGS. 2 and 3.

FIG. 4B shows a second embodiment of wedge-shaped vane 24, identified as wedge-shaped vane 224. Slot 262 is similar to slot 62 (shown in FIG. 4A), except slot 262 has a width less than a diameter of bolt hole 248. Thus, each leg 264, 266 of trailing edge 254 is wider than each respective leg 64, 66 (shown in FIG. 4A).

Figure 4C:
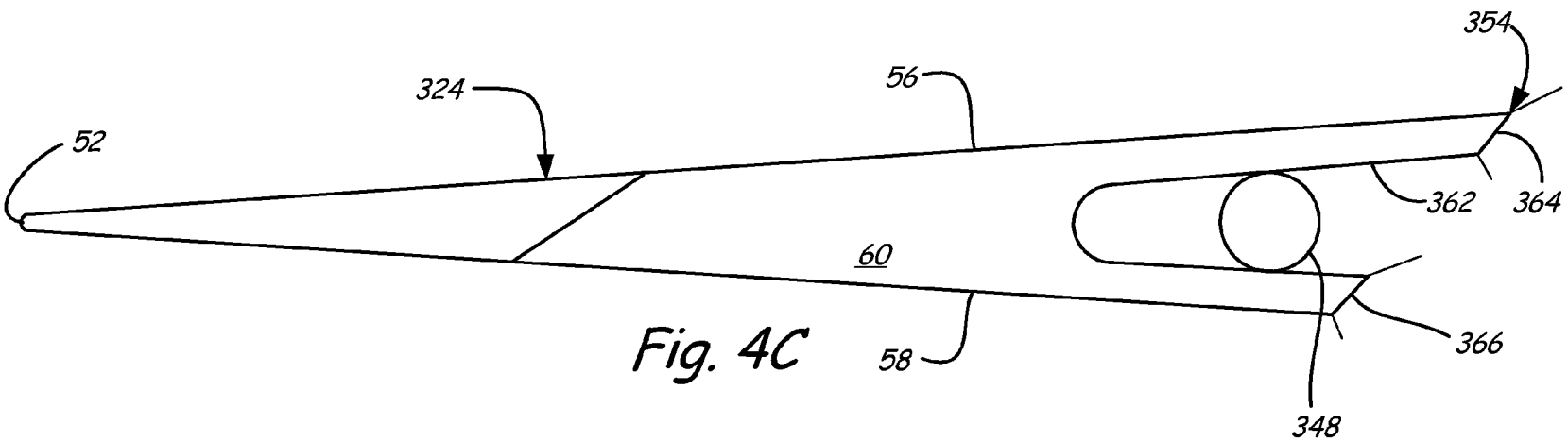
FIG. 4C is a top view of a third embodiment of the wedge-shaped vane of the diffuser shown in FIGS. 2 and 3.

FIG. 4C shows a third embodiment of wedge-shaped vane 24, identified as wedge-shaped vane 324. Slot 362 is similar to slot 62 (shown in FIG. 4A), except slot 362 extends from trailing edge 54 through bolt hole 348 toward leading edge 52. Thus, each leg 364, 366 of trailing edge 354 is longer than each respective leg 64, 66 (shown in FIG. 4A).

Figure 4D:
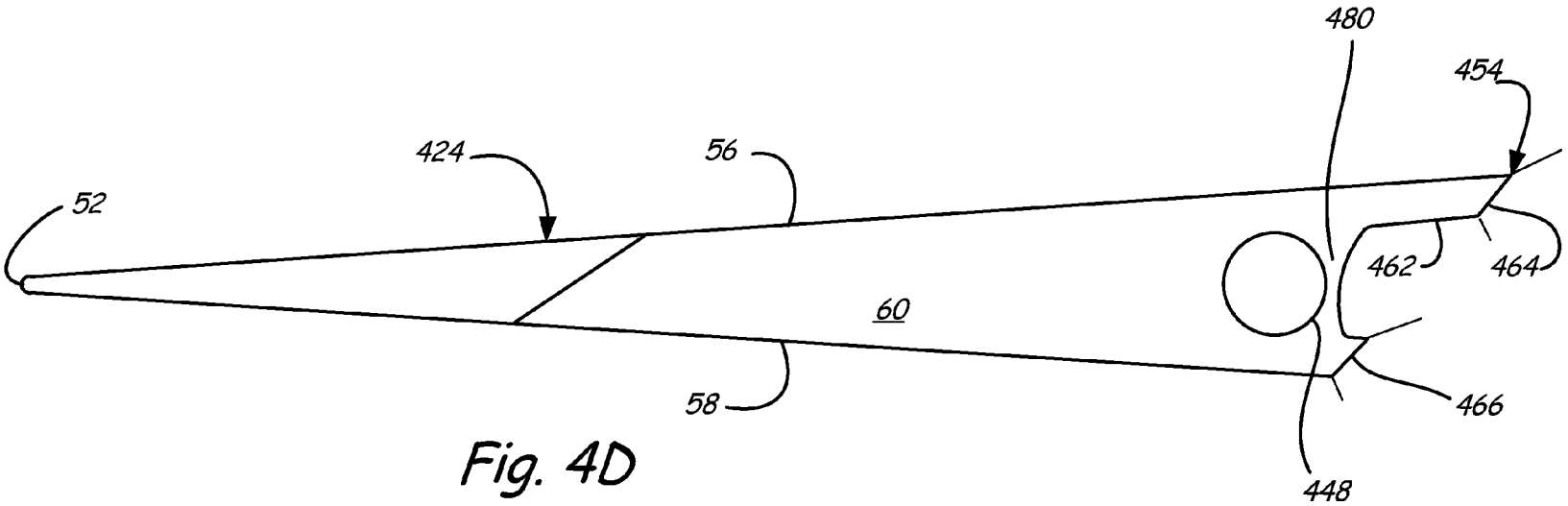
FIG. 4D is a top view of a fourth embodiment of the wedge-shaped vane of the diffuser shown in FIGS. 2 and 3.

FIG. 4D shows a fourth embodiment of wedge-shaped vane 24, identified as wedge-shaped vane 424. Slot 462 is similar to slot 62 (shown in FIG. 4A), except slot 462 extends from trailing edge 54 toward bolt hole 448 and leading edge 52, but stops short of bolt hole 448. Thus, slot 462 is separated from bolt hole 448 by bridge portion 480 of wedge-shaped vane 424, and each leg 464, 466 of trailing edge 454 is shorter than each respective leg 64, 66 (shown in FIG. 4A).

In further alternative embodiments, the dimensions of slots 62, 262, 362, and 462 can be further varied so long as their shape and size are suitable for strength, gas flow, and mass requirements.

Figure 6:
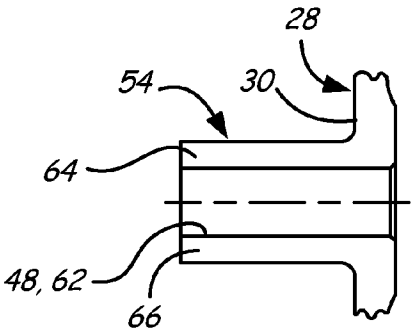
FIG. 6 is a sectional view of the wedge-shaped vane taken along line 6-6 of FIG. 4A.
Figure 5:
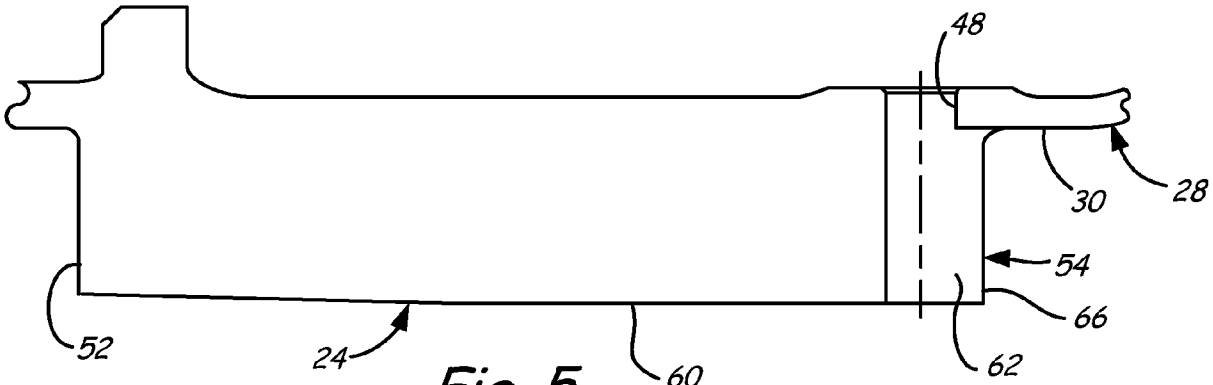
FIG. 5 is a sectional view of the wedge-shaped vane taken along line 5-5 of FIG. 4A.

FIGS. 5 and 6 are sectional views of wedge-shaped vane 24 taken along lines 5-5 and 6-6, respectively, of FIG. 4A. These views show greater detail of the interior of slots 62 and bolt holes 48.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims. For example, diffuser 22 need not be limited to gas turbine engines for use on aircraft, but can be used on other applications that benefit from a wedge-type diffuser having relatively low mass vanes. Accordingly, diffuser 22 can be shaped for each particular application.

The invention claimed is:

1. An assembly comprising:

a wedge-type diffuser including:

a diffuser floor;

a plurality of wedge-shaped vanes extending from the diffuser floor and including a top surface, a leading edge and a trailing edge, wherein each of the wedge-shaped vanes has a slot extending from the trailing edge toward the leading edge; and a plurality of bolt holes in each of the wedge-shaped vanes extending from the top surface toward the diffuser floor;

wherein each of the slots intersects one of the plurality of bolt holes.

2. The assembly of claim 1, wherein each slot is substantially centered on the trailing edge, effectively forming two legs at the trailing edge that define the slot.

3. The assembly of claim 1, wherein the wedge-shaped vanes are substantially identical, arranged about a centerline axis, and tilted with respect to the centerline axis.

4. The assembly of claim 1, wherein the diffuser floor includes a radially extending inner platform from which the wedge-shaped vanes extend and includes a longitudinally extending outer platform from which a plurality of straightener vanes extend.

5. The assembly of claim 1, wherein the wedge-type diffuser further includes a plurality of straightener vanes extending from the diffuser floor radially outward from the wedge-shaped vanes.

6. The assembly of claim 1, wherein the trailing edge is wider than the leading edge, and wherein each wedge-shaped vane tapers substantially continuously from the trailing edge to the leading edge.

7. The assembly of claim 1, wherein each slot is sized so as to minimize a trailing edge aerodynamic wake created during operation.

8. The assembly of claim 1, wherein each slot extends along an entire length of the trailing edge from the top surface of each wedge-shaped vane to the diffuser floor.

9. The assembly of claim 8, wherein an interface between each wedge-shaped vane and the diffuser floor is filleted at the trailing edge and at the slot.

10. The assembly of claim 1, and further comprising:

a shroud attached to the wedge-type diffuser such that the wedge-shaped vanes are positioned between the shroud and the diffuser floor.

11. The assembly of claim 10, and further comprising:

a plurality of bolts extending through the bolt holes in each of the wedge-shaped vanes for connecting the wedge-type diffuser to the shroud.

12. The assembly of claim 11, wherein each slot extends from the trailing edge to the bolt hole.

13. The assembly of claim 12, wherein a portion of each slot has a width less than a diameter of the bolt hole.

14. The assembly of claim 11, wherein each slot extends from the trailing edge through the bolt hole.

15. A gas turbine engine comprising:

a rotor assembly comprising:

a compressor impeller; and a turbine connected to the compressor impeller by a shaft;

a combustor positioned along a gas flow path between the compressor impeller and the turbine;

a wedge-type diffuser positioned along the gas flow path between the compressor impeller and the combustor, the wedge-type diffuser including:

a diffuser floor; and a plurality of wedge-shaped vanes extending from the diffuser floor and including a top surface, a leading edge and a trailing edge, wherein each of the wedge-shaped vanes has a slot extending from the trailing edge toward the leading edge;

a shroud attached to the wedge-type diffuser such that the plurality of wedge-shaped vanes are positioned between the shroud and the diffuser floor; and a plurality of bolts extending through bolt holes in each of the wedge-shaped vanes configured to connect the wedge-type diffuser to the shroud;

wherein each of the slots intersects one of the plurality of bolt holes.

16. The gas turbine engine of claim 15, wherein the shaft includes a spline for transmitting power to drive one or more aircraft components.

17. An assembly comprising:

a wedge-type diffuser including:

a diffuser floor; and a plurality of wedge-shaped vanes extending from the diffuser floor and including a top surface, a leading edge and a trailing edge, wherein each of the wedge-shaped vanes has a slot extending from the trailing edge toward the leading edge; and a plurality of bolt holes in each of the wedge-shaped vanes extending from the top surface toward the diffuser floor;

wherein each of the slots intersects one of the plurality of bolt holes and has a width less than a diameter of the bolt hole.

* * * * *